US007839249B2

(12) United States Patent
Tseng et al.

(10) Patent No.: US 7,839,249 B2
(45) Date of Patent: Nov. 23, 2010

(54) SPLITTER

(75) Inventors: Hung-Chieh Tseng, Taoyuan Hsien (TW); Ying-Chian Kang, Taoyuan Hsien (TW); Tsung-Hsien Lee, Taoyuan Hsien (TW); Shu-Hui Chen, Taoyuan Hsien (TW); Hua-Sheng Shih, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 12/191,778

(22) Filed: Aug. 14, 2008

(65) Prior Publication Data

US 2009/0267719 A1 Oct. 29, 2009

(30) Foreign Application Priority Data

Apr. 25, 2008 (TW) ..... 97115308 A

(51) Int. Cl.

| | |
|---|---|
| ***H01F 27/02*** | (2006.01) |
| ***H01F 21/06*** | (2006.01) |
| ***H01F 27/30*** | (2006.01) |
| ***H01F 17/04*** | (2006.01) |

(52) U.S. Cl. ..... 336/83; 336/131; 336/198; 336/208; 336/221; 336/65

(58) Field of Classification Search ..... None
See application file for complete search history.

(56) References Cited

U.S. PATENT DOCUMENTS

| | | | | |
|---|---|---|---|---|
| 5,726,615 | A * | 3/1998 | Bloom | 336/83 |
| 7,078,995 | B2 * | 7/2006 | Hoffman et al. | 336/83 |
| 7,135,949 | B2 * | 11/2006 | Reppe et al. | 336/83 |
| 7,526,615 | B2 * | 4/2009 | Bonwick et al. | 711/133 |
| 7,598,839 | B1 * | 10/2009 | Wedley | 336/212 |
| 2005/0046534 | A1 * | 3/2005 | Gilmartin et al. | 336/83 |
| 2006/0250207 | A1 * | 11/2006 | Shudarek | 336/212 |
| 2008/0068118 | A1 * | 3/2008 | Ushijima et al. | 336/90 |

* cited by examiner

*Primary Examiner*—Elvin G Enad
*Assistant Examiner*—Mangtin Lian
(74) *Attorney, Agent, or Firm*—Muncy, Geissler, Olds & Lowe, PLLC

(57) ABSTRACT

The present invention provides a splitter including a seat, a first inner core, a second inner core, a first coil, an outer core and a second coil. The seat has a bobbin, and the first coil is wound on the bobbin. The first inner core and the second inner core, disposed on the bobbin, are assembled with each other to cover the bobbin. The outer core and the first inner core are assembled with each other. The second coil is disposed between the outer core and the first inner core.

15 Claims, 3 Drawing Sheets

SPLITTER

This Application claims priority of Taiwan Patent Application No. 97115308, filed on Apr. 25, 2008, the entirety of which is incorporated by reference herein.

BACKGROUND OF THE INVENTION

1. Field of the Invention

The present invention relates to a splitter, and in particular, to a splitter featuring a small size.

2. Description of the Related Art

In telecommunication devices, noises or interferences may come with the transmission of signals. Therefore, multiple inductors are applied as splitters in circuits to filter out noises or interferences.

Two or more single packaged inductors can be found in the retail market, respectively disposed on a circuit board of a telecommunication device. The connection between each inductor is completed by a circuit. However, each inductor must have independent core sets, a winding portion, coils and filler material. Accordingly, the cost and the size of the inductor cannot be reduced, resulting in a high cost and a large sized conventional splitter.

Additionally, each inductor is packaged separately, so that an independent core is required to form the structure. Further, working distances must be kept between the inductors to avoid interferences. Overall, it is not possible to reduce the size of the splitter, and thus not suitable to be applied in miniaturized devices.

BRIEF SUMMARY OF THE INVENTION

Accordingly, the present invention provides a splitter utilizing fewer components to form a comparatively small sized structure; thus, minimizing the overall size of the device which comprises the splitter.

The invention provides a splitter for firmly positioning and fixing the coil and the core.

The invention provides a splitter comprising a seat, a first inner core, a second inner core, a first coil, a first outer core and a second coil. The seat has a winding portion, and the first coil is wound on the winding portion. The first inner core and the second inner core, disposed on the seat, are assembled to form a magnetic loop of the first coil. The first outer core is assembled with the first inner core, and the second coil is disposed inside the first outer core.

The splitter further comprises a second outer core and a third coil. The second outer core is assembled with the second inner core, and the third coil is disposed inside the second outer core. Further, the splitter comprises one or more then one third outer core and one or more fourth coil. The third outer core is disposed outside the first outer core or outer side of the second outer core, and the fourth coil is disposed inside the third outer core. Meanwhile, the second coil, the third coil and/or the fourth coil is a self-adhesive coil.

The splitter comprises a circuit board coupled to the first coil and/or the second coil. In the splitter, the seat further comprises at least one pin, and the first coil and/or the second coil is connected to the circuit board by the pin. In addition, the seat comprises a positioning recess for positioning and guiding the first inner core, the second inner core or the first outer core.

In the splitter, the first inner core, the second inner core or the first outer core is an E-shaped core, an I-shaped core, a U-shaped core, a P-shaped core or an RM-shaped core such as an EE core, an EP core, an RM core, an EI core, an ER core, a POT core, an EFD core, an EC core, an EPO core, an EPX core, an EQ core, an ELP core, an ETD core, a UI core, an E core or a PQ core. The first inner core, the second inner core or the first outer core are identical in shape. The first inner core, the second inner core and the first outer core are disposed horizontally or vertically.

As described, the two adjacent coils of the splitter share a portion of the core to minimize the size of the component and the splitter. Thus, the device which comprises the splitter is therefore reduced in size. Meanwhile, the splitter comprises a fixed winding portion, allowing the coil and the inner core to be firmly positioned and fixed on the seat. Moreover, other coils and outer cores can also be positioned and fixed by the positioning recess of the seat.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

Figure 1:
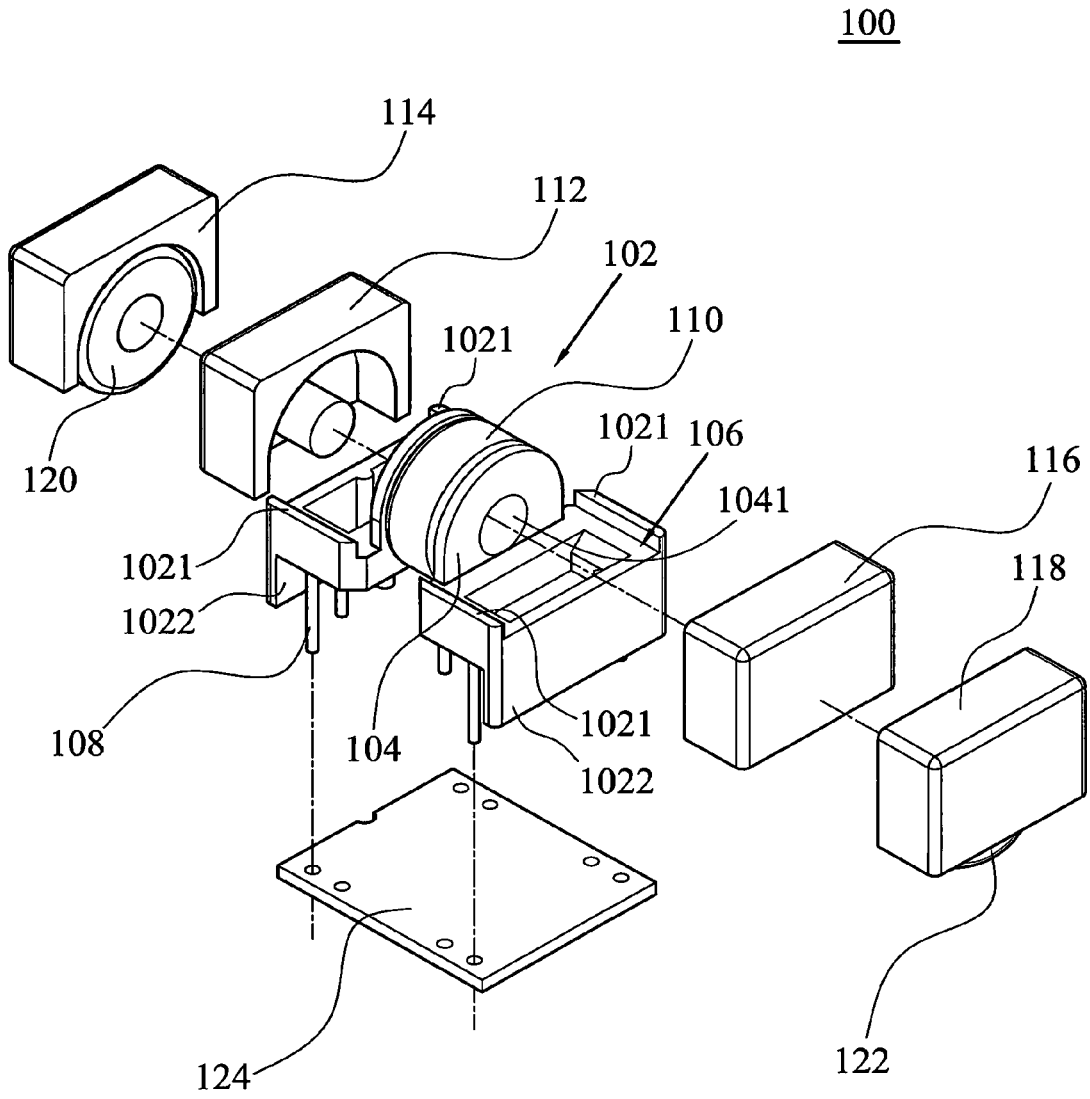
FIG. 1 is a schematic view of a splitter of an embodiment of the invention.

FIG. 1 is a schematic view of a splitter 100 of an embodiment of the invention. The splitter 100 comprises a seat 102, a first inner core 112, a second inner core 116, a first coil 110, a second coil 120, a third coil 122, a first outer core 114 and a second outer core 118. The number of outer cores and the number of coils within the outer core of the splitter 100 may vary according to requirement.

The seat 102 has one or more winding portion 104 and a positioning recess 106. The winding portion 104 is for winding a coil 110. The positioning recess 106 is for positioning and guiding the first inner core 112, the second inner core 116, the first outer core 114, the second outer core 118 and etc. The seat 102 comprises at least one pin 108, and the first coil 110, the second coil 120 and the third coil 122 are electrically connected to the circuit board 124 by the pin 108. The pin 108 can be a single structure, or it can be formed on the ends of the first coil 110, the second coil 120 and third coil 122. The first coil 110, the second coil 120, the third coil 122 or a fourth coil is a self-adhesive coil or a coil wound on the winding portion 104.

The first inner core 112, the second inner core 116, the first outer core 114 and the second outer core 118 are assembled on the seat 102. The first inner core 112 is assembled with the second inner core 116 to form a magnetic loop of the first coil 110, wherein a middle portion of the first inner core 112 is extended into an aperture 1041 of the winding portion 104. The first outer core 114 and the second outer core 118, respectively disposed on outer sides of the first inner core 112 and the second inner core 116, are assembled with the first inner core 112 and the second inner core 116, respectively. The second coil 120 is disposed inside the first outer core 114, and the third coil 122 is disposed inside the second outer core 118. Specifically, the second coil 120 is disposed between the first outer core 114 and the first inner core 112, and the third coil 122 is disposed between the second outer core 118 and the second inner core 116.

Figure 2:
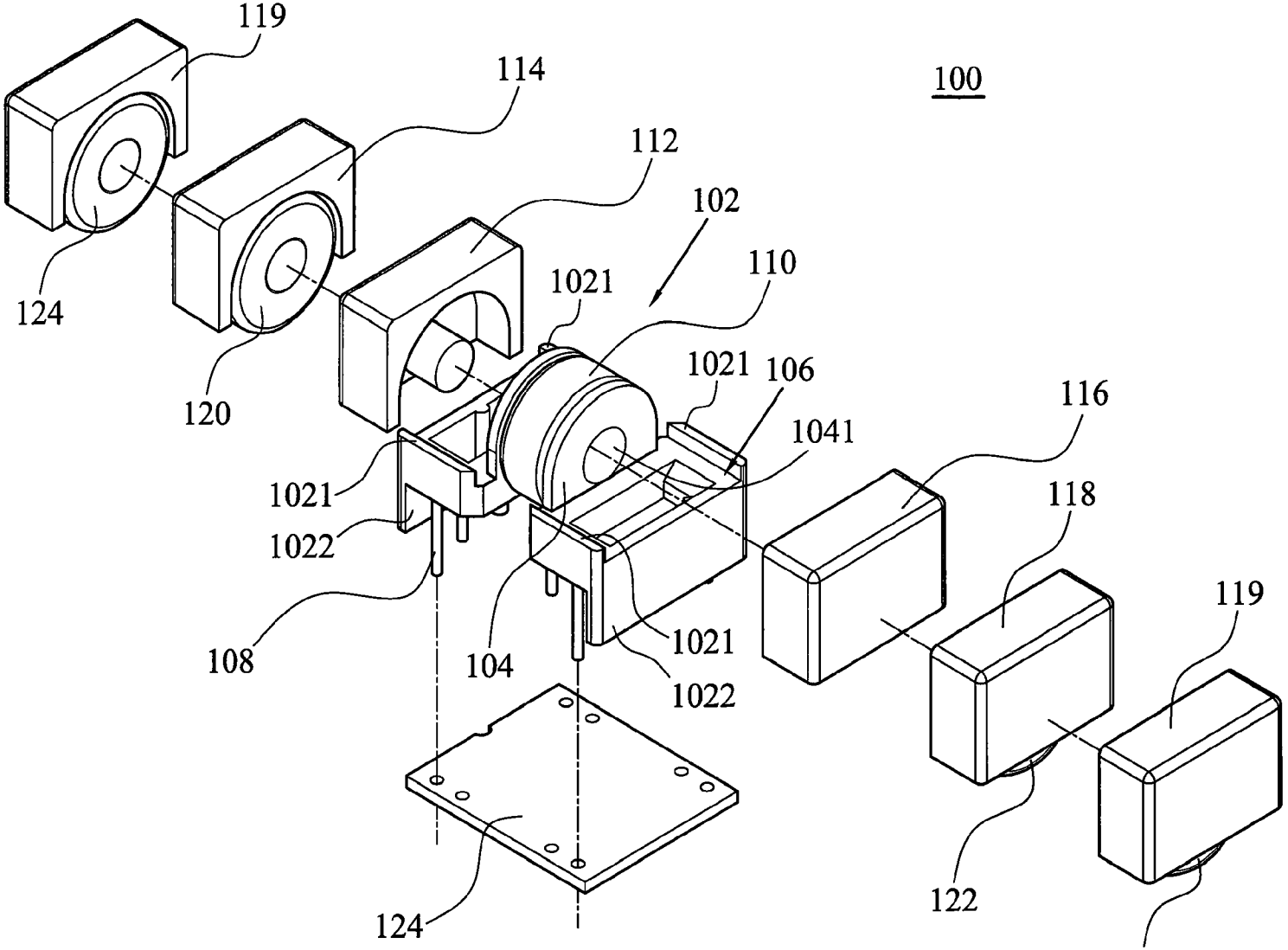
FIG. 2 is a schematic view of a splitter of another embodiment of the invention.
Figure 3:
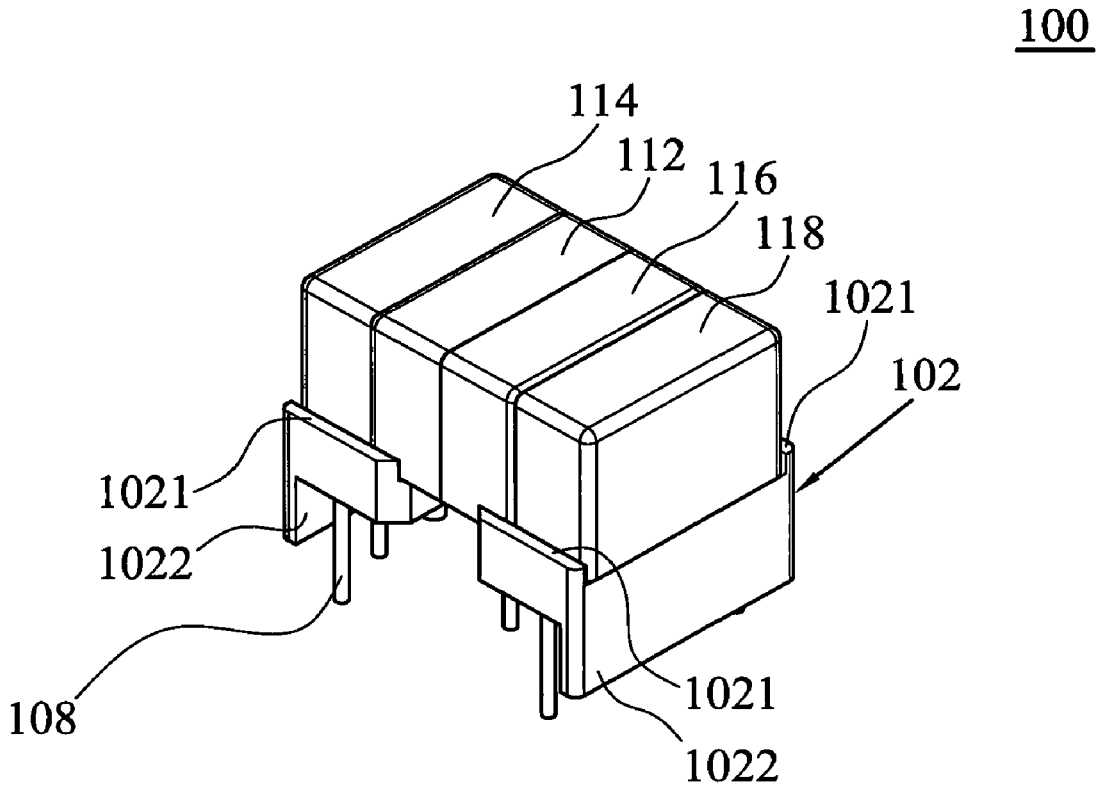
FIG. 3 is a schematic view of the assembled splitter of FIG. 1.

Meanwhile, the splitter 100 is kept small in size and may comprise at least three inductors to fulfill a small-sized multiport connector. Referring to FIGS. 1-3, the seat 102 comprises at least an upstanding edge 1021 on a side of the recess 106, such that the first inner core 112, the first outer core 114, the second inner core 116, and the second outer core 118 are coaxially aligned and positioned on the seat 102. Additionally, the seat 102 comprises at least a vertical wall 1022 which projects downwardly toward the circuit board 124 to protect the pins 108 and the circuit board 124, as shown in FIGS. 1-3, wherein the upstanding edge 1021 and the vertical wall 1022 are respectively formed on the top and bottom sides of the seat 102.

If required, one or more additional outer cores and corresponding coils are disposed on outer sides of the first outer core 114 and the second outer core 118 to form a small-sized splitter with more inductors, thus reducing the size of the device utilizing the splitter. For example, referring to FIG. 2, in a splitter comprising the first outer core 114 or the second outer core 118, one or more third outer cores 119 are added outside the first outer core 114 or the second outer core 118, and one or more fourth coils 124 are disposed inside the third outer cores 119.

The first inner core 112, the second inner core 116, the first outer core 114, the second outer core 118 and the third outer core 119 is an E-shaped core, an I-shaped core, a U-shaped core, a P-shaped core or an RM-shaped core such as an EE core, an EP core, an RM core, an EI core, an ER core, a POT core, an EFD core, an EC core, an EPO core, an EPX core, an EQ core, an ELP core, an ETD core, a UI core, an E core or a PQ core, wherein the first inner core 112, the second inner core 116, the first outer core 114, the second outer core 118 and the third outer core 119 can be identical in shape. The first inner core 112, the second inner core 116, the first outer core 114, the second outer core 118 and/or the third outer core 119 is disposed horizontally or vertically.

Accordingly, the two adjacent coils of the splitter in the invention share a portion of the core to minimize the size of the component and the splitter; thus, reducing the size of the device which comprises the splitter. Meanwhile, the splitter comprises a fixed winding portion, allowing the coil and the inner core to be firmly positioned and fixed on the seat. Moreover, other coils and outer cores can also be positioned and fixed by the positioning recess of the seat.

While the present invention has been described by way of example and in terms of preferred embodiment, it is to be understood that the present invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A splitter, comprising:

a seat having at least one winding portion;

a first coil wound on the winding portion;

a first inner core disposed on the seat;

a second inner core disposed on the seat, the first inner core and the second inner core assembled to form a magnetic loop of the first coil, wherein the winding portion is received in a cavity formed by the first and second inner cores;

a first outer core assembled with the first inner core and disposed on the seat; and a second coil wound on the first outer core and disposed between the first inner core and the first outer core; wherein the first inner core, the second inner core and the first outer core are linearly aligned.

2. The splitter as claimed in claim 1, further comprising:

a second outer core assembled with the second inner core; and a third coil disposed inside the second outer core.

3. The splitter as claimed in claim 2, wherein the first coil, the second coil or the third coil is a self-adhesive coil or a coil wound on the winding portion.

4. The splitter as claimed in claim 2, further comprising:

one or more third outer core disposed outside the first outer core or the second outer core; and one or more fourth coil disposed inside the third outer core.

5. The splitter as claimed in claim 4, wherein the fourth coil is a self-adhesive coil or a coil wound on the winding portion.

6. The splitter as claimed in claim 1, further comprising:

one or more third outer core disposed outside the first outer core; and one or more fourth coil disposed inside the third outer core.

7. The splitter as claimed in claim 6, wherein the fourth coil is a self-adhesive coil or a coil wound on the winding portion.

8. The splitter as claimed in claim 1, further comprising a circuit board coupled to the first coil and the second coil.

9. The splitter as claimed in claim 8, wherein the seat further comprises at least one pin, the first coil and the second coil is coupled to the circuit board by the pin, and the pin is an independent structure or formed on an end of the first coil and the second coil.

10. The splitter as claimed in claim 1, wherein the first coil or the second coil is a self-adhesive coil or a coil wound on the winding portion.

11. The splitter as claimed in claim 1, wherein the seat comprises at least one positioning recess for positioning and guiding the first inner core, the second inner core or the first outer core.

12. The splitter as claimed in claim 1, wherein the first inner core, the second inner core or the first outer core is an E-shaped core, an I-shaped core, a U-shaped core, a P-shaped core or an RM-shaped core.

13. The splitter as claimed in claim 1, wherein the first inner core, the second inner core or the first outer core is an EE core, an EP core, an RM core, an EI core, an ER core, a POT core, an EFD core, an EC core, an EPO core, an EPX core, an EQ core, an ELP core, an ETD core, a UI core, an E core or a PQ core.

14. The splitter as claimed in claim 1, wherein the first inner core, the second inner core or the first outer core are identical in shape.

15. The splitter as claimed in claim 1, wherein the first inner core, the second inner core and the first outer core are disposed horizontally or vertically.

* * * * *